US006708423B2

(12) United States Patent
Dölle

(10) Patent No.: US 6,708,423 B2
(45) Date of Patent: Mar. 23, 2004

(54) DEVICE FOR DEWATERING A FIBROUS MATERIAL WEB

(75) Inventor: Klaus Dölle, Kisslegg (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/265,368

(22) Filed: Oct. 7, 2002

(65) Prior Publication Data

US 2003/0101614 A1 Jun. 5, 2003

(30) Foreign Application Priority Data

Dec. 4, 2001 (DE) ..... 101 59 411

(51) Int. Cl.[7] ..... F26B 3/00

(52) U.S. Cl. ..... 34/454; 34/114; 34/116; 162/360.3; 162/358.3

(58) Field of Search ..... 34/95.3, 620, 454, 34/113, 114, 116, 117; 100/153; 162/358.1, 358.3, 358.4, 358.5, 359.1, 360.1, 360.2, 360.3

(56) References Cited

U.S. PATENT DOCUMENTS 4,173,249 A 11/1979 Holkko et al.
4,675,079 A 6/1987 Webster
5,084,137 A * 1/1992 Ilmarinen et al. ..... 162/272
5,650,047 A * 7/1997 Meschenmoser ..... 162/358.3
6,164,198 A * 12/2000 Honkalampi et al. ..... 100/327
6,381,868 B1 5/2002 Grabscheid et al.
6,562,198 B2 * 5/2003 Beck et al. ..... 162/360.3
6,589,394 B2 * 7/2003 Beck ..... 162/360.3

FOREIGN PATENT DOCUMENTS

DE 2829226 1/1979
DE 1088933 4/2001
DE 19946971 4/2001
DE 19946972 4/2001

* cited by examiner

*Primary Examiner*—Ira S. Lazarus
*Assistant Examiner*—Kathryn S. O'Malley
(74) *Attorney, Agent, or Firm*—Greenblum & Bernstein, P.L.C.

(57) ABSTRACT

Device and process for dewatering a fibrous material web by expelling water via gas pressure. The dewatering device includes at least four rolls arranged to radially limit at least one pressure chamber and sealing units arranged to axially limit the at least one pressure chamber. Adjustment devices are arranged to at least partially individually axially adjust positions of the at least four rolls and the sealing units. A pressure gas is introducible into and the fibrous material web is guidable through the at least one pressure chamber.

30 Claims, 2 Drawing Sheets

DEVICE FOR DEWATERING A FIBROUS MATERIAL WEB

CROSS-REFERENCE TO RELATED APPLICATIONS

The present application claims priority under 35 U.S.C. §119 of German Patent Application No. 101 59 411.9 filed Dec. 4, 2001, the disclosure of which is expressly incorporated by reference herein in its entirety.

BACKGROUND OF THE INVENTION

1. Field of the Invention

The invention relates to a device for dewatering a fibrous material web, in particular a paper or cardboard web by expelling water by gas pressure, with at least one pressure chamber limited radially by at least four rolls arranged in parallel and axially by sealing units. A pressure gas can be introduced into the pressure chamber, through which the fibrous material web can be guided.

2. Discussion of Background Information

Such a so-called "BCP press" (Beck Cluster Press) is known, e.g., from German Patent Application No. DE A 199 46 971. Since this is a relatively new technology, there is still room for further optimization measures in its practical implementation.

SUMMARY OF THE INVENTION

The present invention provides a device of the type mentioned at the outset, which ensures the most reliable possible operation with the simplest possible structure.

The invention is directed to a device for dewatering a fibrous material web, e.g., a paper or cardboard web, by expelling water by gas pressure. The dewatering device of the instant invention includes at least one pressure chamber limited radially by at least four rolls arranged parallel to each other and limited axially by sealing units. Moreover, the rolls and sealing units can each be at least partially individually axially adjusted. A pressure gas can be introduced into the pressure chamber, through which the fibrous material web can be guided.

In accordance with the features of the instant invention, a cost-effective commercial manufacture of a reliably functioning BCP press is possible. The individual rolls and sealing units can expand individually according to the respective specific amount of heat and heat absorption and thus exhibit an individual behavior. The rolls and bearing units can now be adjusted, e.g., such that a resulting deviation in the overall length of the roll package is always as small as possible. Thus, an optimum lateral sealing of the pressure chamber is also always possible. Different heat expansions of the rolls and the sealing units can thus be compensated for at least considerably and an optimum, reliable method of operation of the press can be guaranteed.

In a preferred practical embodiment of the device according to the invention, the rolls can be axially adjusted by a control and/or regulating device such that a possible gap between the respective roll ends and the respective sealing unit is kept as small as possible.

Thus the rolls can be axially adjusted by the control and/or regulating device, e.g., such that a possible deviation of the overall length of the roll arrangement from a desired.length that can be preset is kept as small as possible.

It is therefore advantageous in particular for a zero adjustment of the rolls or a zero control or regulation to be conceivable.

In a preferred practical embodiment, the respective position of the rolls is determinable by position sensors, whereby the rolls can be axially adjusted accordingly by the control and/or regulating device depending on the position signals received. One position sensor each can be thereby assigned to the two ends or plugs of a respective roll.

Advantageously the rolls can be axially adjusted by the control and/or regulating device such that their axial centers always at least essentially lie in a common plane perpendicular to their axes.

The sealing units provided on both sides of the roll arrangement can preferably be controlled independently of one another and/or regulated individually.

The rolls can have at least partially a conventional structure which can compensate for sagging. For instance, a camber or a roll with an oil-supported, floating jacket circulating around a carrier is thus conceivable. In principle, however, the use of at least one shoe press unit or a shoe press roll is also possible. The rolls can thus be at least partially, e.g., arched, embodied as a sag compensation roll and/or formed by a shoe press roll.

In a preferred practical embodiment of the device according to the invention, one housing each is provided on both sides of the roll arrangement, in which housing the antifriction bearing units assigned to the relevant roll ends or plugs and the relevant sealing unit are contained. The antifriction bearing units can be mounted floating in the relevant housing. It is thereby possible, e.g., to support each of the bearing units in the relevant housing via a hydrostatic bearing unit.

Advantageously, the antifriction bearing units are identically constructed and each embodied as a fixed bearing.

Expediently, the rolls and/or the sealing units can be individually adjusted axially by the respective piston/cylinder units.

Preferably, each sealing unit is respectively provided with a flexible sealing arrangement. The sealing units can each comprise a seal having the shape of a dog's bone.

The sealing units or sealing arrangements provided on both sides of the roll arrangement are preferably identically embodied, which results in a further reduction of the manufacturing costs.

The present invention is directed to a device for dewatering a fibrous material web by expelling water via gas pressure. The dewatering device includes at least four rolls arranged to radially limit at least one pressure chamber, and sealing units arranged to axially limit the at least one pressure chamber. Adjustment devices are arranged to at least partially individually axially adjust positions of the at least four rolls and the sealing units. A pressure gas is introducible into and the fibrous material web is guidable through the at least one pressure chamber.

In accordance with a feature of the present invention, the fibrous material web can be one of a paper or cardboard web.

According to another feature of the invention, the adjustment devices may include a control and/or regulating devices structured and arranged to axially adjust positions of the at least four rolls to maintain one of a seal and a small gap between the sealing units and respective ends of the at least four rolls.

According to still another feature of the instant invention, the adjustment devices can include comprise control and/or regulating devices structured and arranged to axially adjust positions of the at least four rolls to maintain a possible deviation of an overall length of a roll arrangement of the at least four rolls from a preset length to be as small as possible. The control and/or regulating devices can be arranged to provide a zero adjustment of the at least four rolls or a zero control or regulation.

In accordance with another aspect of the present invention, the adjustment devices may include control and/or regulating devices structured and arranged to axially adjust positions of the at least four rolls. The dewatering device can further include position sensors, arranged to determine respective positions of the at least four rolls, that are coupled to the control and/or regulating devices so that the axially adjustment of the positions of the at least four rolls is made in accordance with the position determinations by the position sensors. At least one position sensor can be assigned to each end of a respective roll. Further, at least one of the at least four rolls can include plugs located at the roll ends, and the at least one position sensor is assigned to each plug of the at least one roll. Further still, at least one position sensor may be assigned to each at least one of an end and a plug of the at least four rolls.

The adjustment devices can include a control and/or regulating devices structured and arranged to axially adjust positions of the at least four rolls to maintain axial centers of the at least four rolls in a common plane perpendicular to the roll axes.

Moreover, the adjustment devices can include a sealing unit positioner structured and arranged to at least one of individually control and individually regulate positions of the sealing units, which are located on both sides of a roll arrangement formed by the at least four rolls.

The at least four rolls can be structured to be at least partially arched, and may include at least one of sag compensation rolls and one of shoe press units and shoe press rolls.

Housings may be located on each side of a roll arrangement formed by the at least four rolls, and the housings can include antifriction bearing units assigned to one of roll ends and plugs of the at least four rolls and the sealing units. The antifriction bearing units may each be mounted floating in the housings. The antifriction bearing units can each be supported in the housings via hydrostatic bearing units. The antifriction bearing units may have identical structures that comprise fixed bearings.

In accordance with another feature of the present invention, the adjustment devices can include piston/cylinder units structured and arranged to axially adjust positions of at least one of the at least four rolls and the sealing units.

According to still another aspect of the invention, the sealing units can include seals having a dog's bone shape.

Moreover, according to another feature of the invention, the sealing units can include flexible sealing arrangements.

The sealing units, which are provided on each side of a roll arrangement formed by the at least four rolls, may be embodied identically.

The sealing units can include first and second plates and elastic elements arranged to couple the first and second plates together for relative movement between the first and second plates. A face of the first plate is structured and arranged to face one of an end and a plug of the at least four rolls, and the first plate face is arranged to maintain one of sealing engagement and at least a small gap with the one of the end and the plug of the at least four rolls to provide an adequate seal for the pressure chamber. Further, the first plate face can include a groove and an O-ring located in the groove, and the O-ring can be arranged to one of contact and maintain the small gap with the one of the end and the plug of the at least four rolls.

In accordance with still another feature of the present invention, the at least four rolls and the sealing units can be structured to exhibit heat expansion characteristics, and the adjustment devices may be arranged to axially adjust positions of the at least four rolls and the sealing units to compensate for the heat expansion.

The present invention is directed to a process for dewatering a fibrous material web in an apparatus that includes at least four rolls arranged to radially limit at least one pressure chamber, sealing units arranged to axially limit the at least one pressure chamber, and adjustment devices coupled to the at least four rolls and the sealing units. The process includes introducing gas into the at least one pressure chamber, and axially adjusting the positions of at least one of the at least four rolls and the sealing units with the adjustment devices. In this manner, one of sealing contact is made and a small gap is formed between the sealing units and ends of the at least four rolls to provide maintain sufficient pressure in the pressure chamber. The process also includes passing the web through the at least one pressure chamber, such that water in the web is expelled by the gas pressure.

In accordance with a feature of the instant invention, the adjustment devices may include piston/cylinder devices coupled the at least four rolls and the sealing units, and the axial adjustment of the at least one of the at least four rolls and the sealing units can be effected by at least one of the piston/cylinder devices.

According to another feature of the invention, the sealing units can include first and second plates and elastic elements arranged to couple the first and second plates together, the axial adjustment of the at least one of the at least four rolls and the sealing units can effect relative movement between the first and second plates. The process can also include positioning a face of the first plate to face one of an end and a plug of the at least four rolls, and locating the first plate face to maintain one of sealing engagement and at least a small gap with the one of the end and the plug of the at least four rolls to provide an adequate seal for the pressure chamber. Moreover, the first plate face can include a groove and an O-ring located in the groove, and the process may also placing the O-ring to one of contact and maintain the small gap with the one of the end and the plug of the at least four rolls.

In accordance with still yet another feature of the present invention, the at least four rolls and the sealing units are structured to exhibit heat expansion characteristics, and the process may further include axially adjusting positions of the at least one of the at least four rolls and the sealing units to compensate for the heat expansion.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
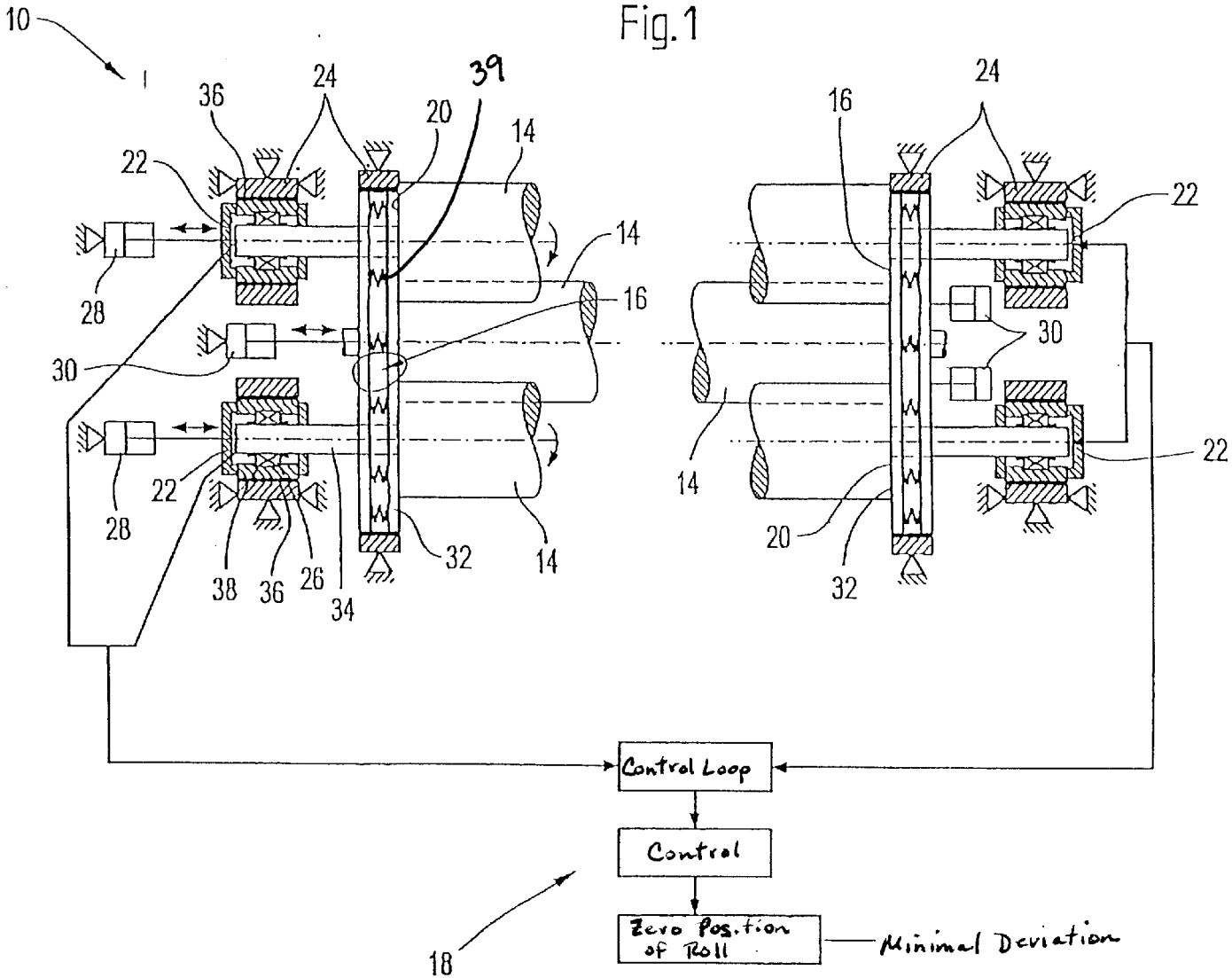
FIG. 1 diagrammatically illustrates a press for dewatering a fibrous material web that expels water by gas pressure.
Figure 2:
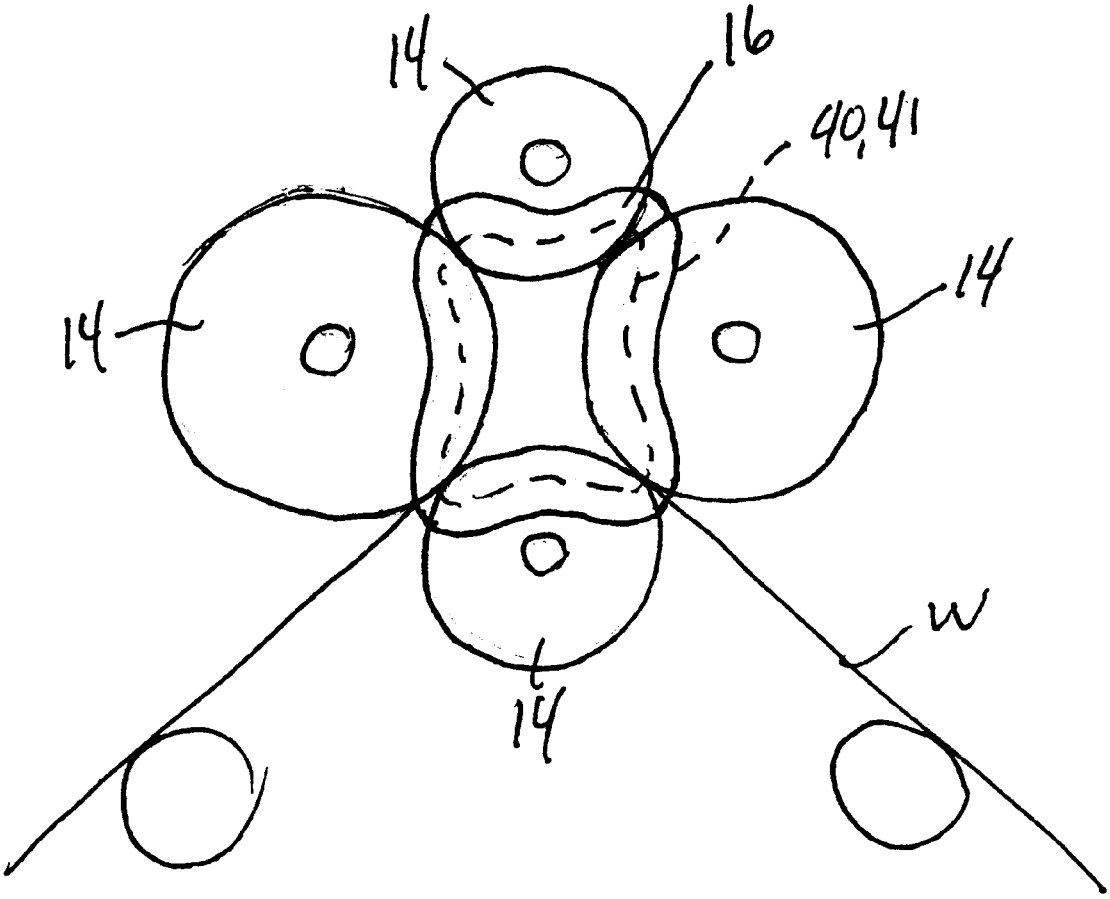
FIG. 2 diagrammatically illustrates an end view of the dewatering press depicted in FIG. 1.

As illustrated in FIGS. 1 and 2, dewatering device 10, e.g., a "BCP press" (Beck Cluster Press), comprises at least one pressure chamber 12, which is limited radially by at least four rolls 14 arranged parallel to each other and limited axially by lateral sealing units 16.

Four rolls 14 are provided in the exemplary embodiment, however, for the sake of clarity and ease of description, the front roll has been omitted FIG. 1. A pressure gas can be introduced into pressure chamber 12, through which the fibrous material web W is guided (see FIG. 2).

Rolls 14 and sealing units 16 can each be individually adjusted axially. For example, the positions of rolls 14 can be axially adjusted by a control and/or regulating device 18 such that sealing contact is maintained or at least such that, if a gap occurs between respective roll ends and a respective sealing unit 16, the gap is kept as small as possible. The position adjustment of rolls 14 can be made, e.g., such that a respective possible deviation of the overall length of the roll arrangement from a desired length, which can be preset, is kept as small as possible. In particular, a zero adjustment of rolls 14 or a zero control or regulation is conceivable.

As can be seen from FIG. 1, respective positions of each of rolls 14 can be determined by position sensors 22. Moreover, the position of rolls 14 can be axially adjusted by the control and/or regulating device 18 depending on the position signals received.

Moreover, one position sensor 22 each is assigned to each end or each end plug 34 of a respective roll 14.

Rolls 14 can be adjusted by control and/or regulating device 18, e.g., such that their axial centers at least essentially always lie in a common plane perpendicular to their axes.

Sealing units 16 provided on both sides of the roll arrangement can be controlled independently of one another and/or individually regulated.

Rolls 14 can have a conventional structure to compensate for sagging. For instance, a respective camber or a respective roll with a floating, oil-supported jacket circulating about a carrier is conceivable. In principle, however, it is also conceivable to use at least one shoe press unit, e.g., a shoe press roll. Thus, rolls 14 can be at least partially arched and embodied, e.g., as a sag compensation roll and/or formed by a shoe press unit or a shoe press roll.

One housing 24 is provided on each side of the roll arrangement, and housing 24 is structured and arranged to include or house antifriction bearing units 26 assigned to relevant roll ends or plugs 34 and sealing units 16.

Antifriction bearing units 26 are each mounted floating in relevant housing 24, and are supported in housing 24, e.g., via a hydrostatic bearing unit 36. Each antifriction bearing unit 26 can have an identical structure and can each comprise a fixed bearing 38.

Individual rolls 14 can be axially adjusted, e.g, by hydraulic or pneumatic piston/cylinder units 28 and sealing units 16 can be axially adjusted, e.g., by hydraulic or pneumatic piston/cylinder units 30.

Sealing units 16 can each comprise a flexible sealing arrangement 32. Moreover, sealing units 16 or sealing arrangements 32 can each be provided with a seal having the shape of a dog's bone, as illustrated in FIG. 2, or any other suitable shape for sealing the axial end of pressure chamber 12. In this regard, sealing unit 16 can include, e.g., two plates which are coupled to each other via elastic elements 39, e.g., springs or rubber pieces, in order to enable relative movement between the plates. Further, a sealing element 40, e.g., a rubber element such as an O-ring, can be provided on the face of the inner plate of sealing unit 16 arranged adjacent to the roll ends so as to provide sealing contact with the roll ends. The sealing element can be located in a groove 41 formed in the face of the inner plate, such that the formed groove 41 is sufficiently sized to surround the axial end of pressure chamber 12.

Moreover, in accordance with the features of the instant invention, while the inner plate may be moved or tilted from an initial set position due to, e.g., roll expansion, this movement is also effected relative to the outer plate due to elastic elements 39 located between the plates. In this manner, sealing element 40 on the inner plate face of sealing units 16 either maintain the intended sealing contact or ensure that any gaps formed between sealing units 16 and the respective end of the expanding roll are kept small enough to maintain an adequate seal for pressure chamber 12.

Sealing units 16 or sealing arrangements 32 provided on both sides of the roll arrangement are preferably embodied identically.

The positions of individual rolls 14 can be adjusted, e.g., by the individual piston/cylinder units 28, in the direction of their longitudinal axis. Lateral sealing units 16 can also be freely moved, e.g., by piston/cylinder units 30 in the direction of their longitudinal axis. The advantage of this concept is that each roll 14 and each sealing unit 16 can expand freely according to its specific amount of heat and heat absorption and thus behave individually. Moreover, due to the particular shape of sealing unit 16, e.g., dog's bone shaped, sealing unit 16 can be moved by piston/cylinder unit 30 independently of the bearing pins of rolls 14 and, therefore, the path of movement for sealing units 16 by piston/cylinder units 30 is not effected by roll sag, etc.

Roll 14 including assigned bearing unit 26 can now be adjusted by the cylinders or piston/cylinder units 28 such that the smallest possible deviation in the overall length results. A so-called "zero adjustment" is thus possible. The deviation is controlled accordingly by a control loop assigned to control and/or regulating device 18, which determines the respective location of rolls 14 and then stabilizes this by the zero control regarding the slightest deviation in the length difference. Thus, a minimal gap results which is sealed by respective sealing unit 16, which includes the assigned flexible sealing group or sealing arrangement. Sealing units 16 provided on the left and the right side can be individually regulated and controlled independently of one another. Thus, it is possible to eliminate the effects of different heat expansions of rolls 14 and at the same time to guarantee an optimum method of operation of the press.

The antifriction bearing itself can be designed conventionally or as a hydrodynamic bearing. The use of identical components also renders possible, e.g., a cost-effective small-series production. Sealing units 16 or sealing arrangements 32 provided on the left and the right side can also be designed identically, since they are inserted separately into relevant housings 24. The roll drive can be direct or indirect, depending on which coupling concept is provided (fluid coupling, sliding coupling, etc.).

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Numbers

10 Dewatering device
12 Pressure chamber
14 Roll
16 Sealing element
18 Control and/or regulating device
20 Roll end
22 Position sensor
24 Housing
26 Antifriction bearing unit
28 Piston/cylinder unit
30 Piston/cylinder unit
32 Sealing arrangement
34 Roll plugs
36 Hydrostatic bearing unit
38 Fixed bearing
39 Elastic elements
40 O-ring
41 Groove
W Web

What is claimed:

1. A device for dewatering a fibrous material web by expelling water via gas pressure comprising:

at least four rolls arranged to radially limit at least one pressure chamber;

sealing units arranged to axially limit said at least one pressure chamber; and adjustment devices arranged to at least partially individually axially adjust positions of said at least four rolls and said sealing units, wherein a pressure gas is introducible into and the fibrous material web is guidable through said at least one pressure chamber.

2. The device in accordance with claim 1, wherein the fibrous material web comprises one of a paper or cardboard web.

3. The device in accordance with claim 1, wherein said adjustment devices comprise a control and/or regulating devices structured and arranged to axially adjust positions of said at least four rolls to maintain one of a seal and a small gap between said sealing units and respective ends of said at least four rolls.

4. The device in accordance with claim 1, wherein said adjustment devices comprise control and/or regulating devices structured and arranged to axially adjust positions of said at least four rolls to maintain a possible deviation of an overall length of a roll arrangement of said at least four rolls from a preset length to be as small as possible.

5. The device in accordance with claim 4, wherein said control and/or regulating devices are arranged to provide a zero adjustment of said at least four rolls or a zero control or regulation.

6. The device in accordance with claim 1, wherein said adjustment devices comprise control and/or regulating devices structured and arranged to axially adjust positions of said at least four rolls and the device further comprises position sensors, arranged to determine respective positions of said at least four rolls, that are coupled to said control and/or regulating devices so that the axial adjustment of the positions of said at least four rolls is made in accordance with the position determinations by said position sensors.

7. The device in accordance with claim 6, wherein at least one position sensor is assigned to each end of a respective roll.

8. The device in accordance with claim 6, wherein at least one of said at least four rolls comprise plugs located at the roll ends, and said at least one position sensor is assigned to each plug of said at least one roll.

9. The device in accordance with claim 8, wherein at least one position sensor is assigned to each at least one of an end and a plug of said at least four rolls.

10. The device in accordance with claim 1, wherein said adjustment devices comprise a control and/or regulating devices structured and arranged to axially adjust positions of said at least four rolls Sep. 13, 2002 to maintain axial centers of said at least four rolls in a common plane perpendicular to the roll axes.

11. The device in accordance with claim 1, wherein said adjustment devices comprise a sealing unit positioner structured and arranged to at least one of individually control and individually regulate positions of said sealing units, which are located on both sides of a roll arrangement formed by said at least four rolls.

12. The device in accordance with claim 1, wherein said at least four rolls are structured to be at least partially arched, and comprise at least one of sag compensation rolls and one of shoe press units and shoe press rolls.

13. The device in accordance with claim 1, further comprising a housings located on each side of a roll arrangement formed by said at least four rolls, said housings comprising antifriction bearing units assigned to one of roll ends and plugs of said at least four rolls and said sealing units.

14. The device in accordance with claim 13, wherein said antifriction bearing units are each mounted floating in said housings.

15. The device in accordance with claim 13, wherein said antifriction bearing units are each supported in said housings via hydrostatic bearing units.

16. The device in accordance with claim 13, wherein said antifriction bearing units have identical structures that comprise fixed bearings.

17. The device in accordance with claim 1, wherein said adjustment devices comprise piston/cylinder units structured and arranged to axially adjust positions of at least one of said at least four rolls and said sealing units.

18. The device in accordance with claim 1, wherein said sealing units comprise seals having a dog's bone shape.

19. The device in accordance with claim 1, wherein said sealing units comprise flexible sealing arrangements.

20. The device in accordance with claim 1, wherein said sealing units, which are provided on each side of a roll arrangement formed by said at least four rolls, are embodied identically.

21. The device in accordance with claim 1, wherein said sealing units comprise first and second plates and elastic elements arranged to couple said first and second plates together for relative movement between said first and second plates.

22. The device in accordance with claim 21, wherein a face of said first plate is structured and arranged to face one of an end and a plug of said at least four rolls, and said first plate face is arranged to maintain one of sealing engagement and at least a small gap with said one of said end and said plug of said at least four rolls to provide an adequate seal for said pressure chamber.

23. The device in accordance with claim 22, wherein said first plate face comprise a groove and an O-ring located in said groove, and said O-ring is arranged to one of contact and maintain said small gap with said one of said end and said plug of said at least four rolls.

24. The device in accordance with claim 1 wherein said at least four rolls and said sealing units are structured to exhibit heat expansion characteristics, and said adjustment devices are arranged to axially adjust positions of said at least four rolls and said sealing units to compensate for the heat expansion.

25. A process for dewatering a fibrous material web in an apparatus that includes at least four rolls arranged to radially limit at least one pressure chamber, sealing units arranged to axially limit the at least one pressure chamber, and adjustment devices coupled to the at least four rolls and the sealing units, said process comprising:

introducing gas into the at least one pressure chamber axially adjusting the positions of at least one of the at least four rolls and the sealing units with the adjustment devices, whereby one of sealing contact is made and a small gap is formed between the sealing units and ends of the at least four rolls to provide maintain sufficient pressure in the pressure chamber; and passing the web through the at least one pressure chamber, whereby water in the web is expelled by the gas pressure.

26. The process in accordance with claim 25, wherein the adjustment devices comprise piston/cylinder devices coupled the at least four rolls and the sealing units, and the axial adjustment of the at least one of the at least four rolls and the sealing units is effected by at least one of the piston/cylinder devices.

27. The process in accordance with claim 25, wherein the sealing units comprise first and second plates and elastic elements arranged to couple the first and second plates together, wherein the axial adjustment of the at least one of the at least four rolls and the sealing units effects relative movement between the first and second plates.

28. The process in accordance with claim 27, further comprising positioning a face of the first plate to face one of an end and a plug of the at least four rolls, and locating the first plate face to maintain one of sealing engagement and at least a small gap with the one of the end and the plug of the at least four rolls to provide an adequate seal for the pressure chamber.

29. The process in accordance with claim 28, wherein the first plate face comprise a groove and an O-ring located in the groove, and the process further comprises placing the O-ring to one of contact and maintain the small gap with the one of the end and the plug of the at least four rolls.

30. The process in accordance with claim 25, wherein the at least four rolls and the sealing units are structured to exhibit heat expansion characteristics, and the process further comprises axially adjusting positions of the at least one of the at least four rolls and the sealing units to compensate for the heat expansion.

* * * * *